US006890891B1

(12) United States Patent
Liu et al.

(10) Patent No.: US 6,890,891 B1
(45) Date of Patent: May 10, 2005

(54) IN-SITU THERMAL AND INFRARED CURING OF POLYMERIZABLE LUBRICANT THIN FILMS

(75) Inventors: Jianwei Liu, Fremont, CA (US); Michael Joseph Stirniman, Fremont, CA (US); Jing Gui, Fremont, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 125 days.

(21) Appl. No.: 10/234,254

(22) Filed: Sep. 5, 2002

Related U.S. Application Data

(60) Provisional application No. 60/388,399, filed on Jun. 12, 2002.

(51) Int. Cl.[7] ..... C10M 145/14; C10M 147/04; C09J 7/02

(52) U.S. Cl. ..... 508/469; 508/582; 427/385.5; 427/393.5; 427/412.4; 428/422; 428/900

(58) Field of Search ..... 508/469, 582

(56) References Cited

U.S. PATENT DOCUMENTS

| | | | | | |
|---|---|---|---|---|---|
| 4,472,480 | A | * | 9/1984 | Olson | 428/332 |
| 5,030,478 | A | | 7/1991 | Lin et al. | 427/54.1 |
| 5,227,516 | A | * | 7/1993 | Tohzuka et al. | 560/182 |
| 5,431,833 | A | | 7/1995 | Kondo et al. | 252/54.6 |
| 5,510,181 | A | | 4/1996 | Nabata | 428/336 |
| 5,536,425 | A | * | 7/1996 | Kondo et al. | 252/62.51 R |
| 5,578,387 | A | * | 11/1996 | Kai et al. | 428/694 T |
| 5,587,217 | A | | 12/1996 | Chao et al. | 428/65.4 |
| 5,741,577 | A | * | 4/1998 | Yamamoto et al. | 428/212 |
| 5,851,601 | A | | 12/1998 | Mehmandoust et al. | 427/561 |
| 5,965,496 | A | * | 10/1999 | Yamana et al. | 508/244 |
| 5,998,340 | A | * | 12/1999 | Furutani et al. | 508/495 |
| 6,096,385 | A | | 8/2000 | Yong et al. | 427/570 |
| 6,096,694 | A | * | 8/2000 | Tei et al. | 508/562 |
| 6,099,762 | A | | 8/2000 | Lewis | 264/1.33 |
| 6,103,677 | A | * | 8/2000 | Furutani et al. | 508/465 |
| 6,204,504 | B1 | | 3/2001 | Lewis | 250/365 |
| 6,323,163 | B1 | | 11/2001 | Sasaki et al. | 508/307 |
| 6,468,596 | B1 | * | 10/2002 | Liu et al. | 427/508 |
| 6,645,634 | B1 | * | 11/2003 | Shirai et al. | 428/421 |

* cited by examiner

*Primary Examiner*—Ellen M McAvoy
(74) *Attorney, Agent, or Firm*—McDermott Will & Emery LLP

(57) ABSTRACT

A data/information storage and retrieval medium, comprising:

(a) a substrate including a surface; and (b) a thin layer or film of an in situ networked or cross-linked polymeric lubricant thin film bonded to the surface, the thin layer or film of polymeric lubricant obtained from a polymerizable perfluoropolyether derivative by supplying thermal or infra-red (IR) energy thereto.

23 Claims, 1 Drawing Sheet

IN-SITU THERMAL AND INFRARED CURING OF POLYMERIZABLE LUBRICANT THIN FILMS

CROSS-REFERENCE TO PROVISIONAL APPLICATION

This application claims priority from U.S. provisional patent application Ser. No. 60/388,399 filed Jun. 12, 2002, the entire disclosure of which is incorporated herein by reference.

FIELD OF THE INVENTION

The present invention relates to polymerized lubricants having improved chemical resistance and mechanical stability, to their unpolymerized precursors, and to thin film data/information storage and retrieval media comprising thin films of the polymerized lubricant as a topcoat for reducing static and dynamic frictional coefficients of the media when utilized in combination with a flying head read/write transducer. The invention enjoys particular utility in the manufacture and use of thin film type magnetic or magneto-optical ("MO") recording media comprising a stacked plurality of thin film layers formed on a substrate, e.g., a disk-shaped substrate, wherein a thin topcoat layer comprised of a lubricant material is applied to the upper surface of the layer stack for improving tribological performance and chemical stability of the media when utilized with read/write transducer heads operating at very low flying heights.

BACKGROUND OF THE INVENTION

Magnetic and MO media are widely employed in various applications, particularly in the computer industry for data/information storage and retrieval purposes. A magnetic medium in, e.g., disk form, such as utilized in computer-related applications, comprises a non-magnetic, disk-shaped substrate, e.g., of glass, ceramic, glass-ceramic composite, polymer, metal, or metal alloy, typically an aluminum (Al)-based alloy, such as aluminum-magnesium (Al—Mg), having at least one major surface on which a layer stack or laminate comprising a plurality of thin film layers constituting the medium are sequentially deposited. Such layers may include, in sequence from the substrate deposition surface, a plating layer, e.g., of amorphous nickel-phosphorus (Ni—P), a polycrystalline underlayer, typically of chromium (Cr) or a Cr-based alloy, such as chromium-vanadium (Cr—V), a magnetic layer, e.g., of a cobalt (Co)-based alloy, and a protective overcoat layer, typically of a carbon (C)-based material, e.g., diamond-like carbon ("DLC") having good tribological properties. A similar situation exists with MO media, wherein a layer stack or laminate is formed on a substrate deposition surface, which layer stack or laminate typically comprises a reflective layer, e.g., of a metal or metal alloy, one or more rare-earth thermo-magnetic (RE-TM) alloy layers, one or more transparent dielectric layers, and a protective overcoat layer, e.g., a DLC layer, for functioning as reflective, transparent, writing, writing assist, and read-out layers, etc.

In operation of such disk-shaped magnetic and/or MO media, a typical contact start/stop (CSS) method commences when a data transducing head begins to slide against the surface of the disk as the disk begins to rotate. Upon reaching a predetermined high rotational speed, the head floats in air at a predetermined distance from the surface of the disk, where it is maintained during reading and recording operations. Upon terminating operation of the disk drive, the head again begins to slide against the surface of the disk and eventually stops in contact with and pressing against the disk. Each time the head and disk assembly is driven, the sliding surface of the head repeats the cyclic operation consisting of stopping, sliding against the surface of the disk, floating in the air, sliding against the surface of the disk, and stopping.

For optimum consistency and predictability, it is necessary to maintain each transducer head as close to its associated recording surface as possible, i.e., to minimize the flying height of the head. Accordingly, a smooth recording surface is preferred, as well as a smooth opposing surface of the associated transducer head. However, if the head surface and the recording surface are too flat, the precision match of these surfaces gives rise to excessive stiction and friction during the start up and stopping phases, thereby causing wear to the head and recording surfaces, eventually leading to what is referred to as a "head crash." Thus, there are competing goals of reduced head/disk friction and minimum transducer flying height.

According to conventional practices, a lubricant topcoat is uniformly applied over the protective overcoat layer to prevent wear between the disk and the facing surface of the read/write transducer head during CSS operation because excessive wear of the protective overcoat layer increases friction between the transducer head and the disk, eventually leading to catastrophic failure of the disk drive. However, an excess amount of lubricant at the head-disk interface causes high stiction between the head and the disk, which stiction, if excessive, prevents starting of disk rotation, hence causing catastrophic failure of the disk drive. Accordingly, the lubricant thickness must be optimized for stiction and friction.

The continuing requirements for increased recording density and faster data transfer rates necessitating lower flying heights of the data transducing heads and minimized friction/stiction of the head-disk interface have served as an impetus for the development of specialized lubricants for serving as the lubricant topcoat layer overlying the protective overcoat layer. Such lubricants are required to fulfill a variety of functions requiring diverse characteristics and attributes. For example, the lubricant material forming the topcoat layer must be chemically inert, have a low vapor pressure, low surface tension, high thermal stability, mechanical stability under shear stress, and good boundary lubrication properties. In addition to the foregoing, it is critical that the lubricant adhere tightly (as, for example, reflected in the "bonded lube thickness" or "bonded lube ratio") to the underlying surface, i.e., the protective overcoat layer (typically carbon-based), over the lifetime of the disk drive comprising the recording disk and associated flying head data transducer.

Fluoropolyether lubricants have been developed which are in widespread use as materials for forming the lubricant topcoat layers of disk-shaped data/information storage and retrieval media, e.g., magnetic and MO recording media. Fluoropolyether-based lubricants are uniquely suited for use as lubricant topcoat layers in such rotating disk-type recording media in view of their exemplary properties, including inter alia, chemical inertness, low vapor pressure, low surface tension, high thermal stability, mechanical stability under high shear stress, and good boundary lubrication properties. Among the many currently available fluoropolyether lubricants, liquid perfluoropolyethers (PFPE) and derivatives thereof are most commonly employed in forming lubricant topcoat layers on rotatable recording media.

Commercially available PFPE lubricants include KRYTOX™ (DuPont Co., Wilmington, Del.); FOMBLIN™

Z-DOL, Z-TETRAOL, Z-DOL TXS, AM 2001, and AM 3001 (Ausimont Montedison Group, Thorofare, N.J.); and DEMNUM™ SA, SH, SP, and SY (Daikin Industries, Ltd., Osaka, Japan). A number of these commercially available PFPE-based lubricants are substituted with 2 to 4 polar end-groups, such as 2–4 hydroxyl or carboxyl groups, which polar end-groups are provided for enhancing adhesion of the polymeric lubricant molecules to the surface of the recording media, e.g., the surface of a carbon-based protective overcoat layer. Application of the PFPE-based lubricants to the media surface may be performed by any standard technique, e.g., dipping, spraying, spin coating, etc., followed by drying to remove any volatile solvent(s) therefrom, and if desired, followed by tape burnishing. A more recently developed technique for applying thin films of polymeric lubricants to media surfaces comprises generation of a vapor of the lubricant followed by condensation of the vapor on the media surface.

As indicated above, conventional PFPE-based lubricants generally comprise 2–4 polar groups or moieties at either end of a generally linear, perfluorinated alkylpolyether molecule, for facilitating direct bonding to a surface, and thus provide improved adhesion of the lubricant topcoat layer to the surface of the protective overcoat layer. Such polar functional groups, however, are not necessarily chemically inert, i.e., they may exhibit varying degrees of chemical inertness, and consequently, the above-described conventional PFPE-based lubricants may disadvantageously undergo chemical reactions prior or subsequent to their application to the media surface. In particular, contamination of the lubricant topcoat layer with a Lewis acid, e.g., aluminum oxide ($Al_2O_3$), may promote rapid degradation of the lubricant topcoat layer. Furthermore, as the thickness of each of the carbon-based protective overcoat and lubricant topcoat layers are continuously being reduced in view of the ever-increasing requirements for recording media with ultra-high areal storage density, advanced lubricants which provide improved mechanical protection as well as improved lubricity are required.

In view of the above, there exists a clear need for improved methodology for applying or forming thin films of advanced polymeric lubricants onto surfaces of thin film recording media, e.g., in disk form, wherein the polymeric lubricant films exhibit improved chemical resistance and tribological properties vis-a-vis the conventional methodology described above. According to the present invention, such goals are met by in situ thermally- or infrared-catalyzed conversion (i.e., polymerization) of suitable precursor lubricant compounds or derivatives into networked (i.e., cross-linked) polymers which are strongly bonded to the surfaces of the protective overcoat layers of the media, wherein the precursor lubricant compounds are derived from conventional lubricant materials, e.g., generally linear perfluoropolyethers or derivatives thereof.

The present invention thus addresses and solves problems and difficulties in achieving high performance lubricant thin films for use in the manufacture of thin film, disk-shaped magnetic and MO data/information storage and retrieval media, while maintaining full compatibility with all aspects of conventional automated manufacturing technology therefor, including productivity requirements necessary for economic competitiveness. In addition, the present invention provides improved thin film magnetic and MO media having stabilized, chemically networked or cross-linked lubricant films derived from a precursor lubricant material. Further, the methodology afforded by the present invention enjoys diverse utility in the manufacture of various other devices and/or articles requiring formation of stable, high performance lubricant thin films thereon.

DISCLOSURE OF THE INVENTION

An advantage of the present invention is an improved composition for forming, in situ, a networked or cross-linked polymeric lubricant thin film bonded to a surface of a substrate.

Another advantage of the present invention is an improved method for forming, in situ, a networked or cross-linked polymeric lubricant thin film bonded to a surface of a substrate.

A further advantage of the present invention is an improved data/information storage and retrieval medium comprising an in situ networked or cross-linked polymeric lubricant film.

A still further advantage of the present invention is a method of synthesizing an in situ polymererizable derivative of a perfluoropolyether compound for use as a precursor material.

Yet another advantage of the present invention is an improved data/information storage and retrieval medium.

Additional advantages and other aspects and features of the present invention will be set forth in the description which follows and in part will become apparent to those having ordinary skill in the art upon examination of the following or may be learned from the practice of the present invention. The advantages of the present invention may be realized and obtained as particularly pointed out in the appended claims.

According to an aspect of the present invention, the foregoing and other advantages are obtained in part by a composition for forming, in situ, a networked or cross-linked polymeric lubricant thin film bonded to a surface of a substrate, comprising a polymerizable perfluoropolyether derivative curable by supplying thermal or infra-red (IR) energy thereto.

According to embodiments of the present invention, the polymerizable perfluoropolyether derivative comprises a generally linear perfluoropolyether chain with a reactive moiety or functional group at each end of the chain which undergoes reaction upon supplying of the thermal or IR energy to form a networked or cross-linked polymer of the perfluoropolyether derivative.

Embodiments of the invention include those wherein the generally linear perfluoropolyether chain comprises a plurality of $—(C_xF_{2x}O)_n—$ repeating units, wherein x in each unit is independently an integer from about 1 to about 10 and n is an integer from about 10 to about 30; and each of the reactive moieties or functional groups is selected from the group consisting of acrylate, methacrylate, styrene, α-methyl styrene, and vinyl ester moieties or functional groups.

According to particular embodiments of the present invention, the polymerizable perfluoropolyether derivative comprises a generally linear perfluoropolyether chain having a reactive acrylate moiety or functional group at each end of the chain, with the following structural formula:

$$H_2C{=}CH—COOH_2CF_2C—(—O—CF_2CF_2—)_q—(—O—CF_2—)_p—O—CF_2CH_2OOC—CH{=}CH_2,$$

wherein the q/p ratio is between about 0.5 and about 1.5; whereas, according to other particular embodiments of the present invention, the polymerizable perfluoropolyether derivative comprises a generally linear perfluoropolyether chain having a reactive vinyl ester moiety or functional group at each end of the chain, with the following structural formula:

$$H_2C{=}CH{-}OOCCF_2C{-}({-}O{-}CF_2CF_2{-})_q{-}({-}O{-}CF_2{-})_p{-}O{-}CF_2COO{-}CH{=}CH_2,$$

wherein the q/p ratio is between about 0.5 and about 1.5.

In each instance, the composition further comprises a solvent for the polymerizable perfluoropolyether derivative.

Another aspect of the present invention is a method for forming, in situ, a networked or cross-linked polymeric lubricant thin film bonded to a surface of a substrate, which method comprises sequential steps of:

(a) providing a substrate including a surface;

(b) applying to the surface a thin layer or film of a composition comprising a polymerizable perfluoropolyether derivative curable by application thereto of thermal or infra-red (IR) energy;

(c) supplying sufficient thermal or IR energy to the thin layer or film to achieve a temperature sufficient to initiate curing reaction of the polymerizable perfluoropolyether derivative to provide networking or cross-linking polymerization thereof; and (d) continuing the supplying of thermal or IR energy for an interval sufficient to achieve a networked or cross-linked polymeric lubricant thin film having a desired bonded lubricant thickness and/or water contact angle.

According to preferred embodiments of the present invention, step (a) comprises providing a data/information storage and retrieval medium as the substrate; e.g., step (a) comprises providing a disk-shaped magnetic or magneto-optical (MO) medium as the substrate, wherein the substrate surface comprises a layer of a carbon (C)-based protective overcoat material; and step (b) comprises applying to the surface a thin layer or film of a composition comprising a polymerizable perfluoropolyether derivative comprised of a generally linear perfluoropolyether chain with a reactive moiety or functional group at each end of said chain which undergoes the curing reaction by supplying thermal or IR energy to form the networked or cross-linked polymer of the perfluoropolyether derivative.

According to embodiments of the present invention, step (b) comprises applying to the surface a thin layer or film of a composition comprising a polymerizable perfluoropolyether derivative wherein the generally linear perfluoropolyether chain comprises a plurality of $-(C_xF_{2x}O)_n-$ repeating units, wherein x in each unit is independently an integer from about 1 to about 10 and n is an integer from about 10 to about 30; and step (b) comprises applying to the surface a thin layer or film of a composition comprising a polymerizable perfluoropolyether derivative wherein each of the reactive moieties or functional groups is selected from the group consisting of acrylate, methacrylate, styrene, α-methyl styrene, and vinyl ester moieties or functional groups.

In accordance with particular embodiments of the present invention, step (a) comprises providing a disk-shaped magnetic or magneto-optical (MO) medium as the substrate, wherein the substrate surface comprises a layer of a carbon (C)-based protective overcoat material; and step (b) comprises applying to the surface a thin layer or film of a composition comprising a polymerizable perfluoropolyether derivative with a generally linear perfluoropolyether chain having a reactive acrylate moiety or functional group at each end of the chain, with the following structural formula:

$$H_2C{=}CH{-}COOH_2CF_2C{-}({-}O{-}CF_2CF_2{-})_q{-}({-}O{-}CF_2{-})_p{-}O{-}CF_2CH_2OOC{-}CH{=}CH_2,$$

wherein the q/p ratio is between about 0.5 and about 1.5; and step (c) comprises supplying sufficient thermal energy to the thin layer or film to achieve an elevated temperature from about 60 to about 180° C. or step (c) comprises supplying sufficient IR energy to the thin layer or film to achieve an elevated temperature below about 120° C.

According to one alternative, step (c) comprises supplying thermal energy; and step (d) comprises continuing the supplying of thermal energy for from about 1 to about 20 hrs; and according to another, preferred alternative, step (c) comprises supplying IR energy; and step (d) comprises continuing the supplying of IR energy for a substantially reduced interval from about 1 to about 8 min.

A further aspect of the present invention is a data/information storage and retrieval medium, comprising:

(a) a substrate including a surface; and (b) a thin layer or film of an in situ networked or cross-linked polymeric lubricant thin film bonded to the surface, the thin layer or film of polymeric lubricant derived from a polymerizable perfluoropolyether derivative by supplying thermal or infra-red (IR) energy thereto.

According to embodiments of the present invention, the substrate (a) is disk-shaped, comprises a layer stack including at least one magnetic or magneto-optical (MO) recording layer, the substrate surface comprises a layer of a carbon (C)-based protective overcoat material; and the thin layer or film of polymeric lubricant (b) is obtained from a polymerizable perfluoropolyether derivative comprised of a generally linear perfluoropolyether chain with a reactive moiety or functional group at each end of the chain which undergoes reaction upon the supplying of thermal or IR energy to form a networked or cross-linked polymer of the perfluoropolyether derivative.

In accordance with embodiments of the invention, the thin layer or film of polymeric lubricant (b) is obtained from a polymerizable perfluoropolyether derivative comprised of a generally linear perfluoropolyether chain including a plurality of $-(C_xF_{2x}O)_n-$ repeating units, wherein x in each unit is independently an integer from about 1 to about 10 and n is an integer from about 10 to about 30, and each of the reactive moieties or functional groups is selected from the group consisting of acrylate, methacrylate, styrene, α-methyl styrene, and vinyl ester moieties or functional groups.

According to particular embodiments of the present invention, the thin layer or film of polymeric lubricant (b) is obtained from a polymerizable perfluoropolyether derivative comprised of a generally linear perfluoropolyether chain having a reactive acrylate moiety or functional group at each end of the chain, the polymeric lubricant having the following structural formula:

$$-\{-H_2C{-}CH_2{-}COOH_2CF_2C{-}({-}O{-}CF_2CF_2{-})_q{-}({-}O{-}CF_2{-})_p{-}O{-}CF_2CH_2OOC{-}CH_2{-}CH_2{-}\}_n-$$

wherein the q/p ratio is between about 0.5 and about 1.5 and n is an integer indicating the amount or degree of polymerization; and the bonded lubricant thickness and water contact angle of the thin film of polymeric lubricant (b) are respectively about 10 Å and 100°.

A still further aspect of the present invention is a method of synthesizing a polymerizable derivative of a perfluoropolyether, the derivative being useful as a precursor material for forming, upon curing, a polymeric lubricant thin film which is bonded to a surface of a substrate, the method comprising steps of:

(a) providing a perfluoropolyether compound including a generally linear perfluoropolyether chain having a reactive group at each end of the chain; and (b) reacting each of the reactive groups of the perfluoropolyether compound with another compound to form a polymerizable derivative containing a reactive moiety or functional group at each end of the chain which undergoes curing reaction upon supplying thermal or IR energy thereto to form a networked or cross-linked polymer of the derivative.

According to embodiments of the present invention, step (a) comprises providing a perfluoropolyether compound wherein the generally linear perfluoropolyether chain comprises a plurality of $—(C_xF_{2x}O)_n—$ repeating units, wherein x in each unit is independently an integer from about 1 to about 10 and n is an integer from about 10 to about 30; and step (b) comprises reacting each of the reactive groups of the precursor compound with a compound selected from the group consisting of acrylate, methacrylate, styrene, α-methyl styrene, and vinyl ester compounds.

In accordance with particular embodiments of the present invention, step (a) comprises providing a perfluoropolyether compound having the following formula:

$$HOH_2CF_2C—(—O—CF_2CF_2—)_q—(—O—CF_2—)_p—O—CF_2CH_2OH,$$

wherein the q/p ratio is between about 0.5 and about 1.5; and step (b) comprises reacting each hydroxyl (—OH) reactive end group of the perfluoropolyether compound with acrylic chloride ($H_2C{=}CH—COCl$) to form a polymerizable derivative having the following formula:

$$H_2C{=}CH—COOH_2CF_2C—(—O—CF_2CF_2—)_q—(—O—CF_2—)_p—O—CF_2CH_2OOC—CH{=}CH_2.$$

According to further particular embodiments of the present invention, step (a) comprises providing a perfluoropolyether compound having the following formula:

$$ClCOF_2C—(—O—CF_2CF_2—)_q—(—O—CF_2—)_p—O—CF_2COCl,$$

wherein the q/p ratio is between about 0.5 and about 1.5; and step (b) comprises reacting each chloro (—Cl) reactive end group of the perfluoroployether compound with acetaldehyde ($H_3C—CHO$) to form a polymerizable vinyl ester derivative having the following formula:

$$H_2C{=}CH—OOCCF_2C—(—O—CF_2CF_2—)_q—(—O—CF_2—)_p—O—CF_2COO—CH{=}CH_2.$$

Yet another aspect of the present invention is a data/information storage and retrieval medium, comprising:

(a) a substrate including a layer stack thereon, the layer stack including a surface and at least one magnetic or magneto-optical (MO) recording layer; and (b) in situ polymerized means bonded to the surface of the layer stack for lubricating the surface thereof.

Additional advantages and aspects of the present invention will become readily apparent to those skilled in the art from the following detailed description, wherein embodiments of the present invention are shown and described, simply by way of illustration of the best mode contemplated for practicing the present invention. As will be described, the present invention is capable of other and different embodiments, and its several details are susceptible of modification in various obvious respects, all without departing from the spirit of the present invention. Accordingly, the drawings and description are to be regarded as illustrative in nature, and not as limitative.

BRIEF DESCRIPTION OF THE DRAWINGS

The following detailed description of the embodiments of the present invention can best be understood when read in conjunction with the following drawings, wherein.

DESCRIPTION OF THE INVENTION

Figure 1:
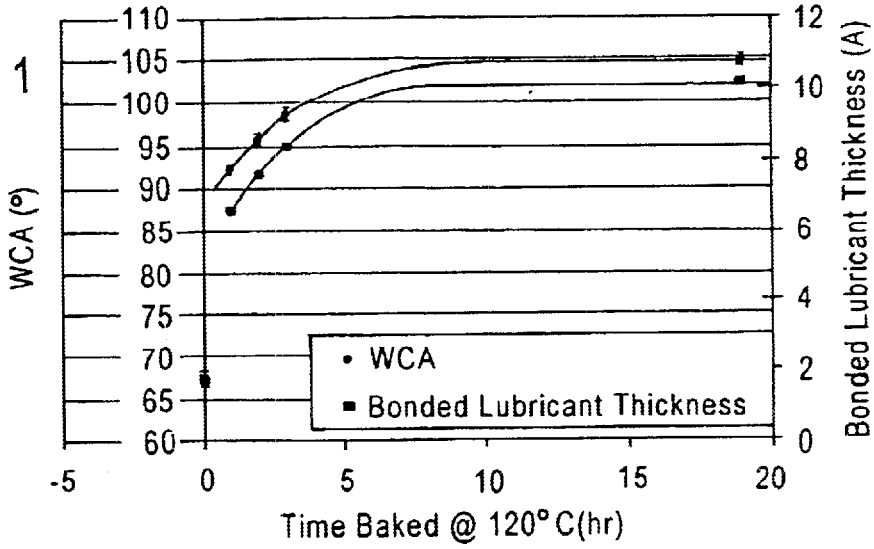
FIG. 1 is a graph for showing the variation of the water contact angle (in degrees) and bonded lubricant thickness (in Å) as a function of thermal heating time (in hours at 120° C.) of a thin film of an acrylated perfluoropolyether (Z-DOL)

The present invention is based upon the discovery by the inventors that significant improvement in the properties of perfluoropolyether-based lubricants bonded to substrate surfaces, e.g., surfaces of thin film magnetic and/or magneto-optical (MO) recording media with carbon (C)-containing protective overcoat layers, can be obtained by means of a process wherein a derivative of a generally linear chain perfluoropolyether compound is formed which contains polymerizable functional groups or moieties at each end of the chain, the derivative is applied as a thin film to the surface of the media, in conventional fashion, and the thin film then subjected to an in situ polymerization process comprising supplying thermal or infrared energy thereto to achieve an elevated temperature within a preselected temperature range. The resultant in situ polymerized thin film of lubricant exhibits substantially improved water contact angles and bonded lubricant thicknesses, relative to lubricant thin films comprised of similar, but unpolymerized, linear chain perfluoropolyether compounds. The inventive methodology thus facilitates formation of recording media with very strongly surface-bonded, chemically and mechanically stable lubricant thin films heretofore unavailable according to prior art practices.

According to the invention, therefore, compositions are provided for forming, in situ, a networked or cross-linked polymeric lubricant thin film bonded to a surface of a substrate, comprising a polymerizable perfluoropolyether derivative curable by supplying sufficient thermal or infrared (IR) energy thereto sufficient to achieve a preselected elevated temperature, the polymerizable perfluoropolyether derivative comprising a generally linear perfluoropolyether chain with a reactive moiety or functional group at each end of the chain which undergoes polymerization reaction upon supplying of the thermal or IR energy to form a networked or cross-linked polymer of the perfluoropolyether derivative.

According to the invention, the generally linear perfluoropolyether chain comprises a plurality of $—(C_xF_{2x}O)_n—$ repeating units, wherein x in each unit is independently an integer from about 1 to about 10 and n is an integer from about 10 to about 30, and each of the reactive moieties or functional groups is selected from the group consisting of acrylate, methacrylate, styrene, α-methyl styrene, and vinyl ester moieties or functional groups. By way of illustration, but not limitation, examples of suitable polymerizable perfluoropolyether derivatives include those comprising a generally linear perfluoropolyether chain having a reactive acrylate moiety or functional group at each end of the chain, with the following structural formula:

$$H_2C{=}CH—COOH_2CF_2C—(—O—CF_2CF_2—)_q—(—O—CF_2—)_p—O—CF_2CH_2OOC—CH{=}CH_2,$$

wherein the q/p ratio is between about 0.5 and about 1.5, and those comprising a generally linear perfluoropolyether chain having a reactive vinyl ester moiety or functional group at each end of said chain, with the following structural formula:

$$H_2C{=}CH{-}OOCCF_2C{-}({-}O{-}CF_2CF_2{-})_q{-}({-}O{-}CF_2{-})_p{-}O{-}CF_2COO{-}CH{=}CH_2,$$

wherein the q/p ratio is between about 0.5 and about 1.5.

In order to facilitate application of a thin film of the polymerizable perfluoropolyether derivative to the substrate/workpiece surface, e.g., a carbon (C)-containing protective overcoat layer of a thin film magnetic or magneto-optical (MO) recording medium, as by a conventional technique (e.g., dipping, spraying, etc.), the composition typically further comprises a suitable solvent, e.g., a perfluorocarbon, fluorohydrocarbon, or a hydrofluoroether, illustratively Vertrel XF or HFE 7100, for dissolving, dispersing, or suspending the polymerizable perfluoropolyether derivative therein at a suitable concentration.

According to the invention, thermal- or IR-catalyzed, polymerizable derivatives of perfluoropolyether derivatives suitable for use as precursor compounds, which upon curing, form polymeric lubricant thin films bonded to the substrate/workpiece, may be conveniently synthesized via a method comprising steps of:

(a) providing a perfluoropolyether compound including a generally linear perfluoropolyether chain having a reactive group at each end of the chain; and (b) reacting each of the reactive groups of the perfluoropolyether compound with another compound to form a polymerizable derivative containing a reactive moiety or functional group at each end of the chain which undergoes curing reaction upon supplying thermal or IR energy thereto to form a networked or cross-linked polymer of the derivative.

Typically, according to the invention, step (a) comprises providing a perfluoropolyether compound wherein the generally linear perfluoropolyether chain comprises a plurality of $-(C_xF_{2x}O)_n-$ repeating units, x in each unit is independently an integer from about 1 to about 10 and n is an integer from about 10 to about 30; and step (b) comprises reacting each of the reactive groups of the perfluoropolyether compound with a compound selected from the group consisting of acrylate, methacrylate, styrene, α-methyl styrene, and vinyl ester compounds.

By way of illustration, according to a preferred embodiment of the invention, step (a) comprises providing a perfluoropolyether compound having the following formula:

$$HOH_2CF_2C{-}({-}O{-}CF_2CF_2{-})_q{-}({-}O{-}CF_2{-})_p{-}O{-}CF_2CH_2OH,$$

wherein the q/p ratio is between about 0.5 and about 1.5; and step (b) comprises reacting, e.g., at room temperature and with stirring in a suitable solvent such as triethylamine $[(C_2H_5)_3N]$, each hydroxyl (—OH) reactive end group of the perfluoropolyether compound reacts with an acrylic chloride ($H_2C{=}CH{-}COCl$) molecule to form a polymerizable derivative having the following formula:

$$H_2C{=}CH{-}COOH_2CF_2C{-}({-}O{-}CF_2CF_2{-})_q{-}({-}O{-}CF_2{-})_p{-}O{-}CF_2CH_2OOC{-}CH{=}CH_2,$$

which reaction is followed by vacuum distillation to recover the product in the form of a clear liquid oil.

According to another exemplary embodiment of the invention, step (a) comprises providing a perfluoropolyether compound having the following formula:

$$ClCOF_2C{-}({-}O{-}CF_2CF_2{-})_q{-}({-}O{-}CF_2{-})_p{-}O{-}CF_2COCl,$$

wherein the q/p ratio is between about 0.5 and about 1.5; and step (b) comprises reacting, e.g., at room temperature (~25° C.) and with stirring of a solution of the perfluoropolyether compound in a suitable solvent such as triethylamine $(C_2H_5)_3N$, each chloro (—Cl) reactive end group of the perfluoropolyether compound with reacts with an acetaldehyde ($H_3C{-}CHO$) molecule to form a polymerizable vinyl ester derivative having the following formula:

$$H_2C{=}CH{-}OOCCF_2C{-}({-}O{-}CF_2CF_2{-})_q{-}({-}O{-}CF_2{-})_p{-}O{-}CF_2COO{-}CH{=}CH_2.$$

A method according to the invention for forming, in situ, a networked or cross-linked polymeric lubricant thin film bonded to a surface of a substrate, comprises sequential steps of:

(a) providing a substrate/workpiece including a surface;

(b) applying to the surface a thin layer or film of a composition (as described supra) comprising a polymerizable perfluoropolyether derivative, e.g., by a conventional technique, such as dipping the surface in a solution of the derivative in a suitable solvent, which polymerizable derivative is curable by application thereto of thermal or infra-red (IR) energy;

(c) supplying sufficient thermal or IR energy to the thin layer or film to achieve a temperature sufficient to initiate curing reaction of the polymerizable perfluoropolyether derivative to provide networking or cross-linking polymerization thereof; and, (d) continuing the supplying of the thermal or IR energy for an interval sufficient to achieve a networked or cross-linked polymeric lubricant thin film having a desired bonded lubricant thickness and/or water contact angle.

In preferred embodiments of the invention, the substrate/workpiece provided in step (a) is a disk-shaped magnetic or magneto-optical (MO) medium wherein the surface comprises a layer of a carbon (C)-based protective overcoat material; and the thin layer or film of the composition applied to the surface of the substrate/workpiece in step (b) comprises a polymerizable perfluoropolyether derivative comprised of a generally linear perfluoropolyether chain with a reactive moiety or functional group at each end of the chain which undergoes curing reaction by the supplying of thermal or IR energy to form the networked or cross-linked polymer of the perfluoropolyether derivative.

According to the invention, each of the reactive moieties or functional groups is selected from the group consisting of acrylate, methacrylate, styrene, α-methyl styrene, and vinyl ester moieties or functional groups, and the generally linear perfluoropolyether chain comprises a plurality of $-(C_xF_{2x}O)_n-$repeating units, wherein x in each unit is independently an integer from about 1 to about 10 and n is an integer from about 10 to about 30.

Illustrative embodiments of the invention are those wherein step (a) comprises providing a disk-shaped magnetic or magneto-optical (MO) medium as the substrate/workpiece, wherein the surface thereof comprises a layer of a carbon (C)-based protective overcoat material; and step (b) comprises applying to the surface a thin layer or film of a composition comprising a polymerizable perfluoropolyether derivative with a generally linear perfluoropolyether chain having a reactive acrylate moiety or functional group at each end of the chain, with the following structural formula:

$$H_2C{=}CH{-}COOH_2CF_2C{-}({-}O{-}CF_2CF_2{-})_q{-}({-}O{-}CF_2{-})_p{-}O{-}CF_2CH_2OOC{-}CH{=}CH_2,$$

wherein the q/p ratio is between about 0.5 and about 1.5; and step (c) comprises supplying sufficient thermal energy to the thin layer or film to achieve an elevated temperature from about 60 to about 180° C. or step (c) comprises supplying sufficient IR energy to the thin layer or film to achieve an elevated temperature below about 120° C.

According to alternative embodiments offered by the inventive methodology, step (c) comprises supplying thermal energy; and step (d) comprises continuing the supplying of thermal energy for from about 1 to about 20 hrs., or step (c) preferably comprises supplying IR energy; and step (d) comprises continuing the supplying of IR energy for from about 1 to about 8 min.

Data/information storage and retrieval media fabricated according to the above method comprise:

(a) a substrate including a surface; and (b) a thin layer or film of an in situ networked or cross-linked polymeric lubricant thin film bonded to the surface, the thin layer or film of polymeric lubricant obtained from a polymerizable perfluoropolyether derivative by supplying thermal or infra-red (IR) energy thereto according to the above-described method.

According to embodiments of the invention, the substrate (a) is disk-shaped, comprises a layer stack including at least one magnetic or magneto-optical (MO) recording layer (as described in more detail supra), the substrate surface comprises a layer of a carbon (C)-based protective overcoat material; and the thin layer or film of polymeric lubricant (b) is obtained from a polymerizable perfluoropolyether derivative (synthesized as, for example, described supra) comprised of a generally linear perfluoropolyether chain with a reactive moiety or functional group at each end of the chain which undergoes reaction upon the supplying of thermal or IR energy to form a networked or cross-linked polymer of the perfluoropolyether derivative.

Typically, the thin layer or film of polymeric lubricant (b) is obtained from a polymerizable perfluoropolyether derivative comprised of a generally linear perfluoropolyether chain including a plurality of $—(C_xF_{2x}O)_n—$ repeating units, wherein x in each unit is independently an integer from about 1 to about 10 and n is an integer from about 10 to about 30, and each of the reactive moieties or functional groups is selected from the group consisting of acrylate, methacrylate, styrene, α-methyl styrene, and vinyl ester moieties or functional groups.

An exemplary embodiment according to the invention is one where the thin layer or film of polymeric lubricant (b) is obtained from a polymerizable perfluoropolyether derivative comprised of a generally linear perfluoropolyether chain having a reactive acrylate moiety or functional group at each end of the chain, the polymeric lubricant having the following structural formula:

$$—\{—H_2C—CH_2—COOH_2CF_2C—(—O—CF_2CF_2—)_q—(—O—CF_2—)_p—O—CF_2CH_2OOC—CH_2—CH_2—\}_n—$$

wherein the q/p ratio is between about 0.5 and about 1.5, n is an integer indicating the amount or degree of polymerization, and the bonded lubricant thickness and water contact angle of the thin film of polymeric lubricant (b) are respectively about 10 Å and 100°.

EXAMPLE

Supercritical fluid extracted fractions of Fomblin Z-DOL, a linear chain perfluoropolyether ("PFPE") from Ausimont, Thorofare, N.J., having the structural formula $HOH_2CF_2C—(—O—CF_2CF_2—)_q(—O—CF_2—)_p—O—CF_2CH_2OH$, with molecular weights ranging from about 1,000 to about 8,000 Daltons and q/p ratios between about 0.5 and 1.5, were utilized as precursors for reaction with acrylic chloride ($H_2C{=}CHCOCl$). For example, 1 equivalent of Z-DOL reacts, at room temperature, with 2 equivalents of acrylic chloride in 1.05 equivalents of triethylamine $\{(C_2H_5)_3N\}$. After stirring for about 1 hr., followed by vacuum distillation, the following product, an acrylated Z-DOL having the following structural formula is obtained as a clear oil:

$$H_2C{=}CH—COOH_2CF_2C—(—O—CF_2CF_2—)_q—(—O—CF_2—)_p—O—CF_2CH_2OOC—CH{=}CH_2,$$

wherein the q/p ratio is between about 0.5 and about 1.5.

A 0.03% (by wt.) solution of the acrylated Z-DOL in Vertrel XF was then utilized for dip coating carbon protective overcoated magnetic disk media, in conventional manner, with a thin layer or film of a lubricant topcoat comprising the acrylated Z-DOL derivative. It was determined that curing of the topcoat layer at about 120° C. resulted in networking or cross-linking polymerization of the acrylated Z-DOL lubricant film or layer, as follows:

$$H_2{=}CHCOO\text{-}Z\text{-}OOCH{=}CH_2 \rightarrow —\{—CH_2CH_2COO\text{-}Z\text{-}OOCH_2CH_2—\}_n,—$$

where n is an integer indicating the amount or degree of polymerization.

As is evident from the graph of FIG. 1 showing the variation of the water contact angle (in degrees) and bonded lubricant thickness (in Å) as a function of thermal heating time (in hours at 120° C.) of the thin film of acrylated Z-DOL, the increase in both quantities over time indicated that the interactions between the lubricant molecules and between the lubricant molecules and the carbon-containing protective overcoat layer of the disk media increased with time.

Figure 2:
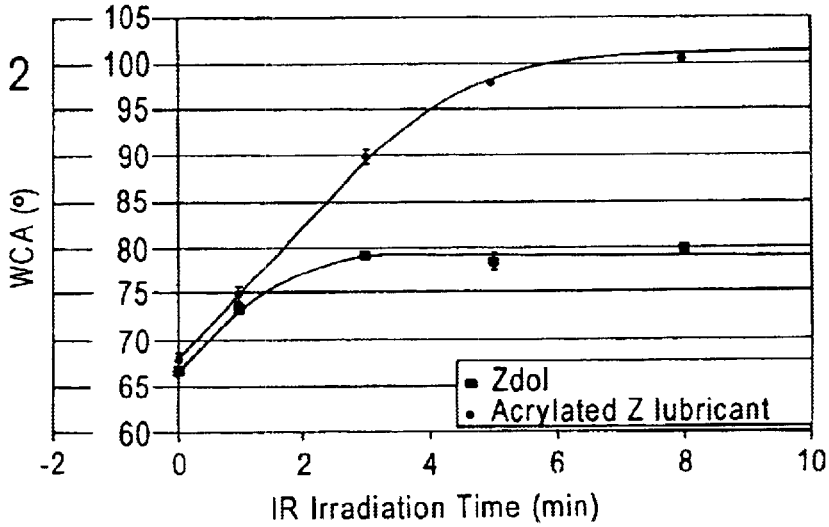
FIG. 2 is a graph for showing the variation of the water contact angle (in degrees) as a function of IR irradiation time (in minutes at about 120° C.) of thin films of an acrylated perfluoropolyether (i.e., acrylated Z-DOL) and Z-DOL.
Figure 3:
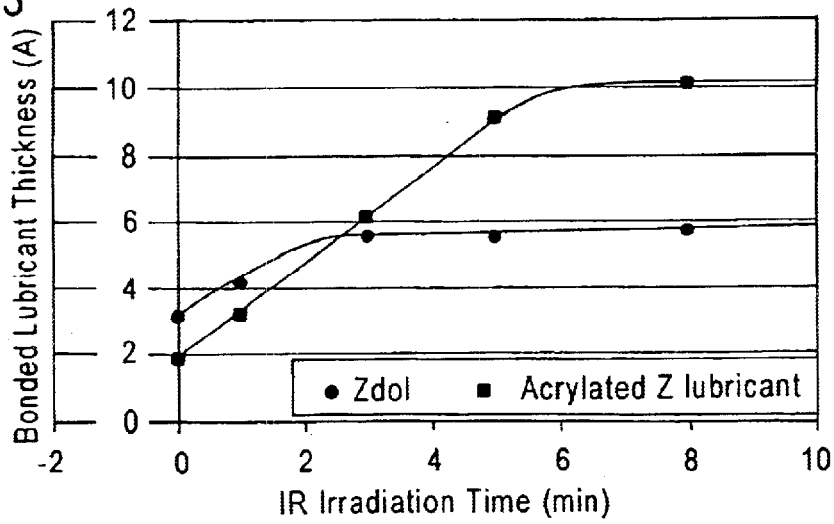
FIG. 3 is a graph for showing the variation of the bonded lubricant thickness (in Å) as a function of IR irradiation time (in minutes at about 120° C.) of thin films of an acrylated perfluoropolyether (i.e., acrylated Z-DOL) and Z-DOL.

FIGS. 2 and 3 are graphs showing the respective variations of the water contact angle (in degrees) and bonded lubricant thickness (in Å) of acrylated Z-DOL and conventional Z-DOL thin films on carbon-containing protective overcoat layers, as a function of IR irradiation time (in minutes at about 120° C.).

Comparison of FIG. 1 with FIGS. 2–3 indicates that the use of IR rather than thermal curing significantly accelerates the curing, i.e., polymerization, process. While the disk temperature during the IR curing process does not exceed the 120° C. temperature of the thermal curing process, the curing rate is still 20–30 times faster. Moreover, as FIGS. 2–3 clearly show, the cross-linked films of acrylated Z-DOL exhibit significantly greater water contact angles (WCA) and bonded lubricant thicknesses (BLT) than the conventional Z-DOL films after equivalent amounts of IR irradiation. The difference, i.e., increase, in both WCA and BLT of the acrylated Z-DOL films is attributed to the stronger lubricant-lubricant and lubricant-carbon protective overcoat interactions provided by the curing process resulting in the in situ networked or cross-linked lubricant thin film.

Use of an infra-red (IR) source according to the invention, rather than an ultra-violet (UV) source, is advantageous in that the IR curing process is gentler, hence more selective. Thus, while the IR photon energy is too low to impart any detrimental effects on the Z-DOL, i.e., PFPE lubricant chain or the carbon-based protective overcoat layer, the UV utilized in conventional commercial polymer curing processes typically involves use of high energy photons to eject photoelectrons from the PFPE and the carbon-based overcoat, disadvantageously resulting in chemical degradation of the PFPE chain and oxidation of the carbon-based overcoat when oxygen ($O_2$) is present during irradiation. Finally, IR sources are of significantly lower cost than UV sources.

The present invention thus provides a number of advantages over conventional methodology utilizing conventional, non-cross-linked perfluoropolyether-based lubricant films utilized in the manufacture and use of disk-shaped, thin film magnetic and/or MO recording media, and is of particular utility in automated manufacturing processing of thin film magnetic and MO recording media requiring formation of stable and durable lubricant topcoat layers for obtaining improved tribological properties. Specifically, the present invention provides for significantly increased water contact angles and bonded lubricant thicknesses, hence stability and resistance of the lubricant topcoat layer to chemically and mechanically induced decomposition and/or degradation, compared to conventional perfluoropolyether-based lubricant thin films. Further, the inventive methodology can be readily practiced and utilized as part of conventional recording media manufacturing technology in view of its full compatibility with all other aspects of automated manufacture of disk-shaped magnetic and MO media. Finally, the inventive methodology is broadly applicable to the manufacture of a number of different products, e.g., mechanical parts, gears, linkages, etc., requiring lubrication.

In the previous description, numerous specific details are set forth, such as specific materials, structures, processes, etc., in order to provide a better understanding of the present invention. However, the present invention can be practiced without resorting to the details specifically set forth. In other instances, well-known processing materials, structures, and techniques have not been described in detail in order not to unnecessarily obscure the present invention.

Only the preferred embodiments of the present invention and but a few examples of its versatility are shown and described in the present invention. It is to be understood that the present invention is capable of use in various other embodiments and is susceptible of changes and/or modifications within the scope of the inventive concept as expressed herein.

What is claimed is:

1. A composition for forming, in situ, a networked or cross-linked polymeric lubricant thin film bonded to a surface of a substrate, comprising a polymerizable perfluoropolyether derivative comprising a generally linear perfluoropolyether chain with a reactive moiety or functional group at each end of said chain which undergoes reaction upon said supplying of thermal or infra-red (IR) energy to form a networked or cross-linked polymer of said perfluoropolyether derivative, wherein each of said reactive moieties or functional groups is selected from the group consisting of styrene, α-methyl styrene, and vinyl ester moieties or functional groups.

2. The composition as in claim 1, wherein said generally linear perfluoropolyether chain comprises a plurality of $—(C_xF_2O)_n—$repeating units, wherein x in each unit is independently an integer from about 1 to about 10 and n is an integer from about 10 to about 30.

3. The composition as in claim 1, wherein said polymerizable perfluoropolyether derivative comprises a generally linear perfluoropolyether chain having a reactive vinyl ester moiety or functional group at each end of said chain, with the following structural formula:

$$H_2C{=}CH—OOCCF_2C—(—O—CF_2CF_2—)_q—(—O—CF_2—)_p—O—CF_2COO—CH{=}CH_2,$$

wherein the q/p ratio is between about 0.5 and about 1.5.

4. The composition as in claim 1, further comprising a solvent for said polymerizable perfluoropolyether derivative.

5. A method for forming, in situ, a networked or cross-linked polymeric lubricant thin film bonded to a surface of a substrate, which method comprises sequential steps of:

(a) providing a substrate including a surface;

(b) applying to said surface a thin layer or film of a composition comprising a polymerizable perfluoropolyether derivative curable by application thereto of thermal or infra-red (IR) energy;

(c) supplying sufficient thermal or IR energy to said thin layer or film to achieve a temperature sufficient to initiate curing reaction of said polymerizable perfluoropolyether derivative to provide networking or cross-linking polymerization thereof; and (d) continuing said supplying of said thermal or IR energy for an interval sufficient to achieve a networked or cross-linked polymeric lubricant thin film having a desired bonded lubricant thickness and/or water contact angle.

6. The method as in claim 5, wherein:

step (a) comprises providing a data/information storage and retrieval medium as said substrate.

7. The method as in claim 6, wherein:

step (a) comprises providing a disk-shaped magnetic or magneto-optical (MO) medium as said substrate.

8. The method as in claim 7, wherein:

step (a) comprises providing a disk-shaped magnetic or magneto-optical (MO) medium as said substrate, wherein said substrate surface comprises a layer of a carbon (C)-based protective overcoat material.

9. The method as in claim 5, wherein:

step (b) comprises applying to said surface a thin layer or film of a composition comprising a polymerizable perfluoropolyether derivative comprised of a generally linear perfluoropolyether chain with a reactive moiety or functional group at each end of said chain which undergoes said curing reaction by said supplying of thermal or IR energy to form said networked or cross-linked polymer of said perfluoropolyether derivative.

10. The method as in claim 9, wherein:

step (b) comprises applying to said surface a thin layer or film of a composition comprising a polymerizable perfluoropolyether derivative wherein said generally linear perfluoropolyether chain comprises a plurality of $—(C_xF_{2x}O)_n—$repeating units, wherein x in each unit is independently an integer from about 1 to about 10 and n is an integer from about 10 to about 30.

11. The method as in claim 9, wherein:

step (b) comprises applying to said surface a thin layer or film of a composition comprising a polymerizable perfluoropolyether derivative wherein each of said reactive moieties or functional groups is selected from the group consisting of acrylate, methacrylate, styrene, α-methyl styrene, and vinyl ester moieties or functional groups.

12. The method as in claim 5, wherein:

step (a) comprises providing a disk-shaped magnetic or magneto-optical (MO) medium as said substrate, wherein said substrate surface comprises a layer of a carbon (C)-based protective overcoat material; and step (b) comprises applying to said surface a thin layer or film of a composition comprising a polymerizable perfluoropolyether derivative with a generally linear perfluoropolyether chain having a reactive acrylate moiety or functional group at each end of said chain, with the following structural formula:

$$H_2C{=}CH—COOH_2CF_2C—(—O—CF_2CF_2—)_q—(—O—CF_2—)_p—O—CF_2CH_2OOC—CH{=}CH_2,$$

wherein the q/p ratio is between about 0.5 and about 1.5.

13. The method as in claim 12, wherein:

step (c) comprises supplying sufficient thermal energy to said thin layer or film to achieve an elevated temperature from about 60 to about 180° C., or step (c) comprises supplying sufficient IR energy to said thin layer or film to achieve an elevated temperature below about 120° C.

14. The method as in claim 13, wherein:

step (c) comprises supplying thermal energy; and step (d) comprises continuing said supplying of said thermal energy for from about 1 to about 20 hrs.

15. The method as in claim 13, wherein:

step (c) comprises supplying IR energy; and step (d) comprises continuing said supplying of said IR energy for from about 1 to about 8 min.

16. A data/information storage and retrieval medium, comprising:

(a) a substrate including a surface; and (b) a thin layer or film of an in situ networked or cross-linked polymeric lubricant thin film bonded to said surface, said thin layer or film of polymeric lubricant obtained from a polymerizable perfluoropolyether derivative, wherein said polymerizable perfluoropolyether comprises a generally linear perfluoropolyether chain with a reactive moiety or functional group, at each end of said chain which undergoes reaction upon said supplying of thermal or IR energy to form a networked or cross-linked polymer of said perfluoropolyether derivative, wherein each of said reactive moieties or functional groups is selected from the group consisting of styrene, α-methyl styrene, and vinyl ester moieties or functional groups.

17. The medium according to claim 16, wherein:

said substrate (a) is disk-shaped, comprises a layer stack including at least one magnetic or magneto-optical (MO) recording layer, and said substrate surface comprises a layer of a carbon (C)-based protective overcoat material.

18. The medium according to claim 16, wherein:

said polymerizable perfluoropolyether derivative includes a plurality of —$(C_xF_{2x}O)_n$—repeating units, wherein x in each unit is independently an integer from about 1 to about 10 and n is an integer from about 10 to about 30.

19. The medium according to claim 16, wherein the bonded lubricant thickness and water contact angle of said thin film of polymeric lubricant (b) are respectively about 10 Å and 10°.

20. A method of synthesizing a polymerizable derivative of a perfluoropolyether, said derivative being useful for forming a precursor material, which upon curing, forms a polymeric lubricant thin film which is bonded to a surface of a substrate, the method comprising steps of:

(a) providing a perfluoropolyether compound including a generally linear perfluoropolyether chain having a reactive group at each end of said chain; and (b) reacting each of said reactive groups of said perfluoropolyether compound with another compound to form a said polymerizable derivative containing a reactive moiety or functional group at each end of said chain which undergoes curing reaction upon supplying thermal or IR energy thereto to form a networked or cross-linked polymer of said derivative.

21. The method as in claim 20, wherein:

step (a) comprises providing a said perfluoropolyether compound wherein said generally linear perfluoropolyether chain comprises a plurality of —$(C_xF_{2x}O)_n$— repeating units, wherein x in each unit is independently an integer from about 1 to about 10 and n is an integer from about 10 to about 30; and step (b) comprises reacting each of said reactive groups of said perfluoropolyether compound with a compound selected from the group consisting of acrylate, methacrylate, styrene, α-methyl styrene, and vinyl ester compounds.

22. The method as in claim 20, wherein:

step (a) comprises providing a said perfluoropolyether compound having the following formula:

$$HOH_2CF_2C—(—O—CF_2CF_2—)_q—(—O—CF_2—)_p—O—CF_2CH_2OH,$$

wherein the q/p ratio is between about 0.5 and about 1.5; and step (b) comprises reacting each hydroxyl (—OH) reactive end group of said perfluoropolyether compound with acrylic chloride ($H_2C$═CH—COCl) to form a said polymerizable derivative having the following formula:

$$H_2C{=}CH—COOH_2CF_2C—(—O—CF_2CF_2—)_q—(—O—CF_2—)_p—O—CF_2CH_2OOC—CH{=}CH_2.$$

23. The method as in claim 20, wherein:

step (a) comprises providing a said perfluoropolyether compound having the following formula:

$$ClCOF_2C—(—O—CF_2CF_2—)_q—(—O—CF_2—)_p—O—CF_2COCl,$$

wherein the q/p ratio is between about 0.5 and about 1.5; and step (b) comprises reacting each chloro (—Cl) reactive end group of said perfluoropolyether compound with acetaldehyde ($H_3C$—CHO) to form a polymerizable vinyl ester derivative having the following formula:

$$H_2C{=}CH—OOCCF_2C—(—O—CF_2CF_2—)_q—(—O—CF_2—)_p—O—CF_2COO—CH{=}CH_2.$$

* * * * *